United States Patent [19]

Vaccari

[11] 4,179,827

[45] Dec. 25, 1979

[54] FOOT CLAMPING DEVICE PARTICULARLY FOR SKI BOOTS

[76] Inventor: Franco Vaccari, Via Paleoveneti, 3/3, Montebelluna, Treviso, Italy

[21] Appl. No.: 947,988

[22] Filed: Oct. 2, 1978

[30] Foreign Application Priority Data

Oct. 13, 1977 [IT] Italy ..... 22489/77B[U]
Mar. 15, 1978 [IT] Italy ..... 21178/78B[U]

[51] Int. Cl.[2] ..... A43B 5/04; A43B 21/36
[52] U.S. Cl. ..... 36/119; 36/80
[58] Field of Search ..... 36/117, 119, 80

[56] References Cited

U.S. PATENT DOCUMENTS

| | | | |
|---|---|---|---|
| 2,073,775 | 3/1937 | Baumel | 36/80 |
| 3,798,800 | 3/1974 | Rathmell | 36/80 |
| 4,064,642 | 12/1977 | Vykukal et al. | 36/119 |

FOREIGN PATENT DOCUMENTS

| | | | |
|---|---|---|---|
| 2086994 | 12/1971 | France | 36/119 |

*Primary Examiner*—Patrick D. Lawson
*Attorney, Agent, or Firm*—Guido Modiano; Albert Josif

[57] ABSTRACT

A foot clamping device for ski boots comprises, inside the boot body a presser member at the foot heel region and a threaded peg extending from the presser member and rotatably engaged in a threaded bush associated with a boss on the outside of the boot body. When the boss is rotated by a strap rigid therewith and constituting a closure element for the boot, the presser member is caused to traverse.

12 Claims, 9 Drawing Figures

FOOT CLAMPING DEVICE PARTICULARLY FOR SKI BOOTS

BACKGROUND OF THE INVENTION

This invention relates to a foot clamping device, for use particularly in ski boots.

At the present time, certain types of ski boot use foot clamping devices which comprise presser members disposed inside the body of the boot and acting on the heel region. These presser members comprise a threaded peg which engages in a threaded bush provided on a boss on the outside of the boot body. When the boss is rotated, the presser members are caused to move by virtue of the engagement between the threaded boss and threaded peg, so that the foot becomes firmly gripped inside the boot body.

To enable it to be rotated, the boss is provided with a diametrical slot into which a coin or a similar item can be inserted to enable the boss to be rotated.

This engagement is the source of considerable drawbacks, deriving in particular from the conditions under which ski boots are normally used. In this respect, it is not infrequent for snow or ice to deposit in the diametrical slot, so making it difficult to produce the engagement. It must also be taken into account that generally the user wears gloves, and thus the operation by which the presser members are closed on to the foot is by no means easy to carry out.

SUMMARY OF THE INVENTION

The object of the present invention is to obviate the aforesaid drawbacks by providing a foot clamping device which can be operated with extreme ease and speed, even by a user wearing gloves.

A further object of the present invention is to provide a device, the operation of which is in no way influenced by any snow or ice accumulation, so allowing easy operation under any conditions of use.

A further object of the present invention is to provide a device which can be operated simply by means which form constituent parts of the boot, without having to possess items separate from the boot, such as the coins or screwdrivers presently used.

A further object of the present invention is to provide a foot clamping device which is easily constructed by simple operations, and which is highly competitive from an economical viewpoint.

These and further objects, which will be more apparent hereinafter, are attained by a foot clamping device, particularly for ski boots, according to the invention, characterized in that it comprises, inside the boot body, a presser member acting in a position corresponding with the foot heel region, there extending from said member a threaded peg which is rotatably engaged in a threaded bush associated with a boss on the outside of said body and which, when rotated, causes said presser member to traverse, and comprising, for rotating said boss, a strap rigid at one of its ends with said boss and constituting a closure element for said boot.

BRIEF DESCRIPTION OF THE DRAWINGS

Further characteristics and advantages will be more apparent from the detailed description of a foot clamping device particularly for ski boots, illustrated by way of non-limiting example in the accompanying drawings in which.

DESCRIPTION OF THE PREFERRED EMBODIMENTS

Figure 6:
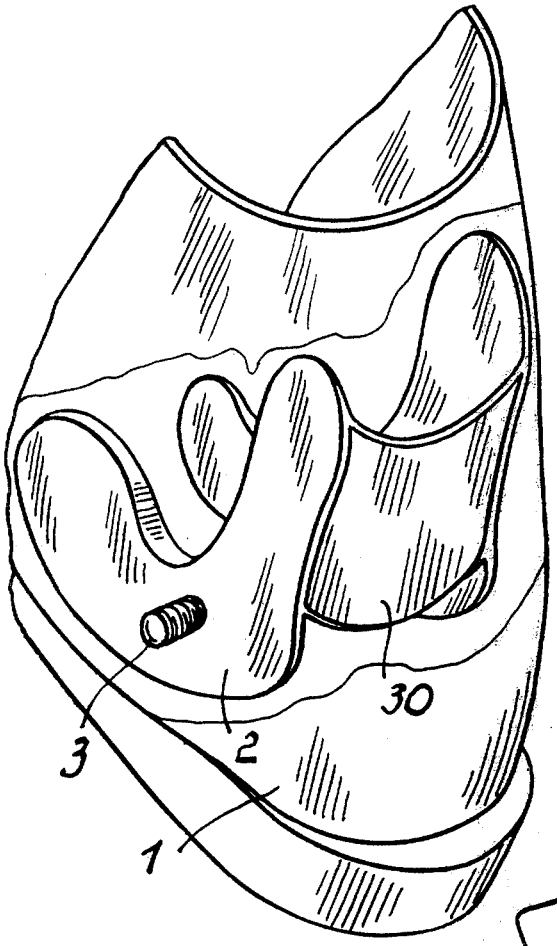
FIGS. 6 and 7 are diagrammatic perspective views of the anti-rotation means for the presser members.
Figure 7:
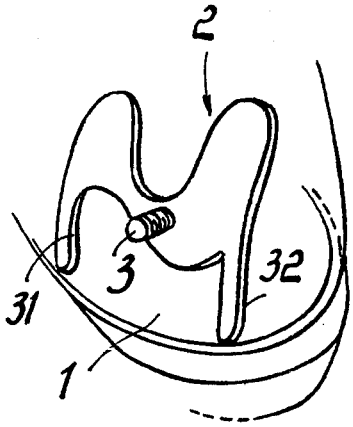

With reference to said figures, the foot clamping device, particularly for ski boots used for the practice of skiing, comprises in the boot body 1 a pair of presser members 2 which act laterally to the foot in a position corresponding with the heel region. For simplicity of description, only one presser member will be described hereinafter, the two presser members being analogous with each other and acting in a like manner.

The presser member 2, which can be of any configuration and which is preferably constituted by a padded element, comprises a threaded peg 3 which extends rigidly from the presser member.

Said threaded peg 3 engages rotatably with a threaded bush 4, which engages in a threaded seat 5 provided in a boss 6 disposed on the outside of the boot.

When the boss 6 is rotated, in the manner described hereinafter, the presser member 2 traverses and therefore exerts a pressure, which can be adjusted as required, on the skier's foot, so clamping the foot inside the body 1.

Figure 1:
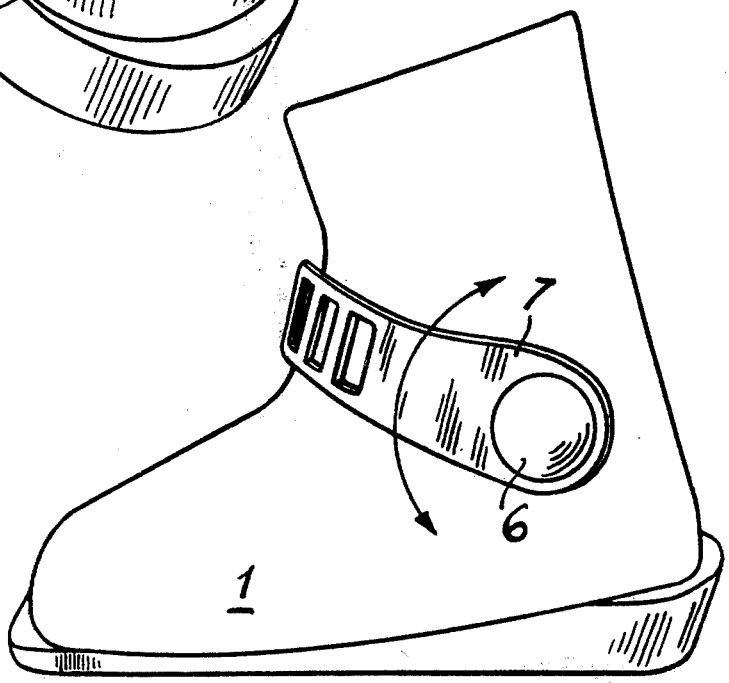
FIG. 1 is a diagrammatic perspective view of a ski boot with the device according to the invention fitted.
Figure 2:
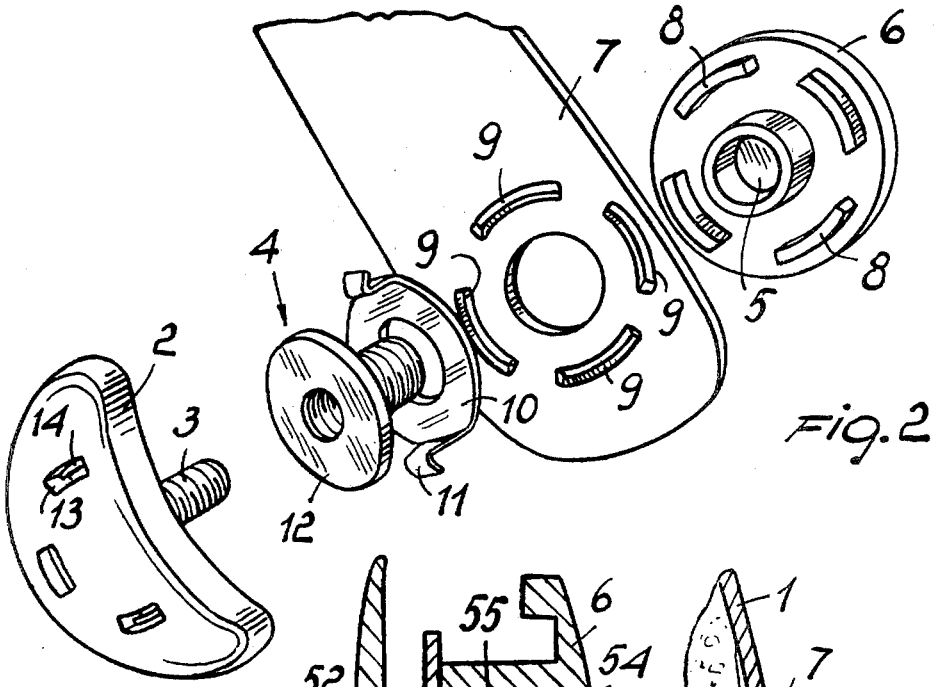
FIG. 2 is an exploded view of the clamping device.

A fundamental characteristic of the invention is that said boss 6 is rotated by using a strap 7 which is rigidly connected at one of its ends to the boss 6, and which, as shown in FIG. 1, acts as a closure element for the boot in that it is provided with the usual boot lacing hooks.

The coupling between the strap 7 and boss 6 is made rigid during rotation by providing the inner face of the boss 6 with projecting teeth 8 which engage in corresponding slots 9 provided in that end of the strap 7 which engages with the boss 6.

To prevent the peg 6 accidentally disengaging from the threaded bush 4, a limit stop is provided constituted by a washer 10 with lateral appendices 11 which engage below a flange 12 disposed at the end of the threaded bush 4. The appendices 11 become inserted in notches 13 provided in the presser member 2 so that they comprise a stop surface 14 against which the appendices 11 about to prevent any further traversing of the presser member 2 relative to the threaded bush 4.

Figure 5:
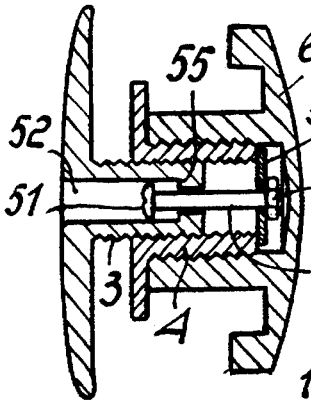
FIG. 5 shows a limit stop for the rotation between the peg and threaded bush.
Figure 3:
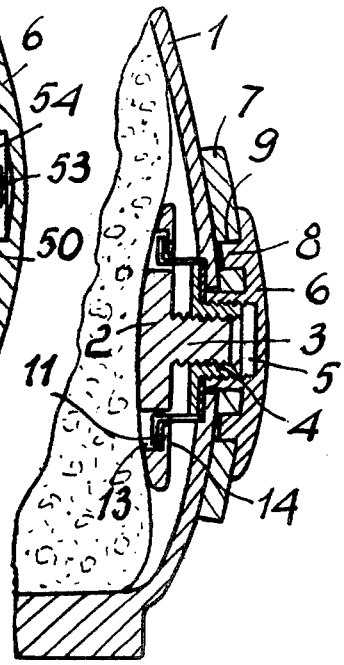
FIG. 3 is a sectional view of the clamping device fitted to a boot.
Figure 4:
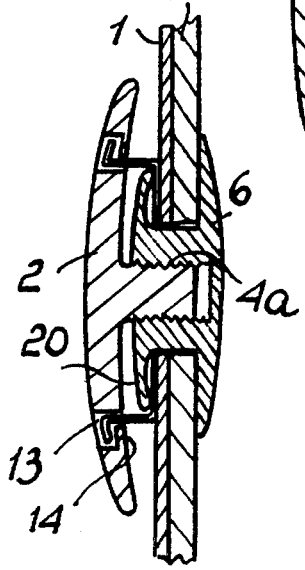
FIG. 4 is a sectional view of a clamping device according to the invention.

As shown in FIG. 5, the limit stop can be constituted by a screw 50, the head 51 of which engages in an axial bore 52 provided in the threaded peg 3. A nut 53 engages with the screw 50 to abut against a washer 54 provided at the end of the threaded bush 4. When the nut 53 abuts against the washer or when the head 51 abuts against an annular stop 55 provided at the end of the bore 52, it is no longer possible for the peg 3 to traverse further relative to the bush 4. FIG. 4 shows an embodiment, conceptually analogous to the preceding, in which the threaded bush 4, instead of being separate from the boss 6, is formed as an internal part of the boss 6 (it being indicated on the drawing with the reference numeral 4*a*), and the lateral edges 20 are clinched to couple the boss 6 to the boot body. The device also comprises anti-rotation means for the presser members 2, i.e. means which prevent the presser member from rotating about the axis of the threaded peg 3, but which enable the presser member only to make a traverse movement in the direction defined by the peg 3.

As shown in FIG. 5, said anti-rotation means are constituted by a rear band 30 which joins together the two presser members 2, so preventing their mutual rotation.

In FIG. 6 the said anti-rotation means are constituted by a front appendix 31 and a rear appendix 32, which extend downwards from each presser member 2 and which abut against the floor of the boot body 1, so preventing rotation of the presser member 2.

Figure 9:
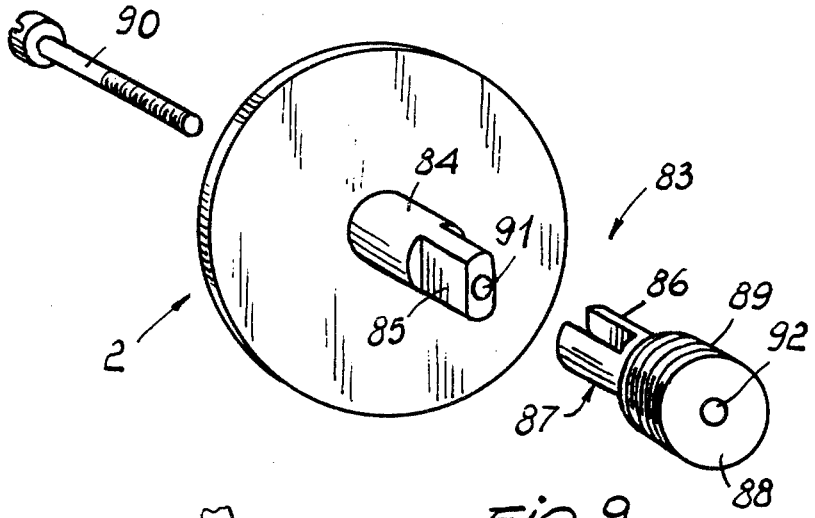
FIG. 9 is a perspective exploded view of the presser device and its peg.
Figure 8:
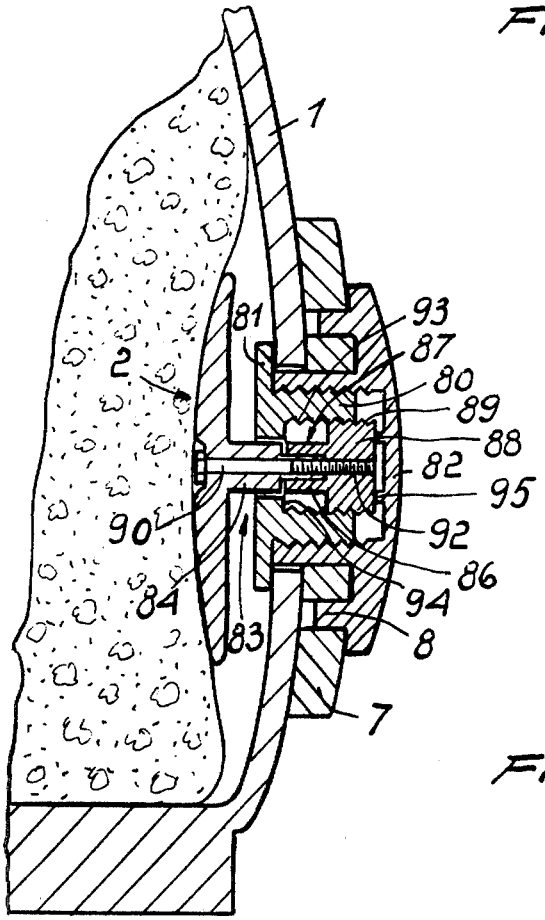
FIG. 8 is a sectional view of a further embodiment of the clamping device.

With reference to FIGS. 8 and 9, the boss is constituted by a bush element 80 comprising a flange 81 disposed on the inside of the body 1, and a cap 82 rigid with the bush element 80 and disposed on the outside of the body 1.

The cap 82 comprises on its inner face the projecting teeth 8 which make the cap 81 rigid with the strap 7, which acts as an engagement member for rotating the boss.

The presser member 2 is provided inside the body 1. A peg element indicated overall by 83 extends from said presser member, and comprises a threaded portion for engagement with the boss.

The peg 83 extending from the presser member 2 is constituted by a shank 84 which terminates in a flattened end 85 which can be inserted into a fork element 86 defined in a bar 87, the other end of which comprises an annular enlargement 88 with a threaded portion 89 on its outer surface.

In practice, the bar element is connected to the shank 84 by engaging the flattened portion 85 with the fork element 86. The connection is made rigid by a screw 90 which passes through an axial bore 91 in the shank 84 and screws into a threaded bore 82 in the bar element 87.

Said bush 80 comprises an inner bore with a female thread 93 with which said threaded portion 89 provided on the enlargement 88 rotatably engages. That end of said inner bore facing the inside of the body 2 comprises an annular rim 94 which abuts against the enlargement 88 to prevent the threaded portion 89 accidentally disengaging from the female thread 93.

Said bush 80 and consequently the female thread 93, and the bar 87 and its threaded portion 89, are constructed of metal so as to guarantee a stable and reliable connection, to enable even large forces to be transmitted.

This embodiment also comprises means for preventing the presser member 2 rotating about its axis, so that the relative rotation between the boss and peg 83 is compelled to cause the presser member 2 to traverse in the direction defined by the peg 83.

There is also provided an external limit stop constituted by a rim 95 provided on the inner face of the cap 82, and against which the enlargement 88 abuts.

Said peg 83 must be constructed in two pieces, constituted by the shank 84 and the bar element 87, in order to enable the threaded portion 89 to be assembled inside the bush 80. In this respect, the threaded portion 89 is firstly engaged in the bush 3, and the bar element 15 is then joined to the shank 12 by the said screw 20.

The use of the clamping device according to the invention is extremely simple. After putting on the boot, the user merely has to rotate the boss 6 by operating the strap 7. He therefore in effect has available a lever constituted by the strap 7, which makes the operation of the boss 6 extremely rapid and simply. The user rotates the boss 6 by the strap 7 until the presser member 2 exerts the required pressure against the foot, and the foot is consequently clamped inside the boot by the force deriving therefrom.

To disengage the foot from the boot, the strap 7 is operated in the reverse direction so that the presser members 2 are caused to traverse in the opposite direction.

From the description, it can be seen that the invention attains the proposed objects, and in particular it must be emphasised that the used of the strap 7 for operating the boss 6 firstly gives the user a type of lever which makes it more easy to rotate the boss 6, and also makes it unnecessary for the user to possess separate means for rotating the boss 6.

In practice the materials used, and the dimensions and shapes can be chosen according to requirements.

I claim:

1. A foot clamping device, particularly for ski boots, comprising, inside the boot body, a presser member acting in a position corresponding with the foot heel region, there extending from said presser member a threaded peg which is rotatably engaged in a threaded bush associated with a boss on the outside of said body and which, when rotated, causes said presser member to traverse, characterized in that it comprises, for rotating said boss, a strap rigid at one end with said boss and constituting a closure element for said boot.

2. A clamping device as claimed in the preceding claim, wherein the engagement between said strap and said boss is obtained by teeth projecting from said boss which engage in corresponding slots provided in said strap.

3. A clamping device as claimed in claim 1, characterized in that it comprises limit stop means for preventing said threaded peg from accidentally disengaging from said threaded bush, and constituted by a washer with lateral appendices which engage with a flange disposed on said bush, said appendices being arranged for insertion into notches provided in said presser member and comprising projections against which said lateral appendices abut in order to obtain the limit stop condition.

4. A clamping device as claimed in claim 3, wherein said limit stop means are constituted by a screw, the head of which engages in an axial bore provided in said threaded peg, with said screw there engaging a nut arranged to abut against a washer provided at the end of said threaded bush.

5. A clamping device as claimed in claim 1, characterized in that it comprises anti-rotation means for said presser members, which prevent said presser members rotating about the axis defined by said threaded peg.

6. A clamping device as claimed in claim 5, wherein said anti-rotation means are constituted by a rear band which connects the left hand presser member to the right hand presser member.

7. A clamping device as claimed in claim 5, wherein said anti-rotation means are constituted by a front appendix and a rear appendix which extend downwards from each of said presser members, and act by contact on the base of said boot body.

8. A foot clamping device particularly for ski boots, as claimed in claim 1, wherein said boss comprises an internal bore with a female thread in which there rotatably engages the threaded portion provided on a peg extending from said presser member, at the inner end of said inner bore there being provided an annular rim which prevents said threaded portion from accidentally disengaging from said inner bore.

9. A foot clamping device particularly for ski boots, as claimed in claim 8, wherein said female thread and said threaded portion are of metal.

10. A foot clamping device particularly for ski boots, as claimed in claim 8, wherein said threaded portion is provided on an annular enlargement which is provided on said peg and which is arranged to abut against said annular rim to obtain the internal limit stop condition against the accidental disengagement of said threaded portion from said inner bore comprising said female thread.

11. A foot clamping device particularly for ski boots, as claimed in claim 1, wherein said peg is constituted by a shank extending rigidly from said presser member and comprising a flattened portion arranged to engage in a fork element provided in a bar element comprising said annular enlargement, in said shank there being provided an axial through bore into which there engages a screw which screws into a threaded bore provided in said bar element in order to rigidly join said bar element to said shank.

12. A foot clamping device particularly for ski boots, as claimed in claim 1, wherein said boss is constituted by a bush element on which there is rigidly fitted a cap accessible from the outside of the boot body, a rim being provided on the inner face of said cap to act as an external limit stop for the movement of said peg.

* * * * *